US006102322A

United States Patent [19]

Cordes

[11] Patent Number: 6,102,322

[45] Date of Patent: Aug. 15, 2000

[54] BATCH WINDER

[75] Inventor: Rainer Cordes, Lingen, Germany

[73] Assignee: Neuenhauser Maschinenbau GmbH & Co. KG, Neuenhaus, Germany

[21] Appl. No.: 09/124,882

[22] Filed: Jul. 30, 1998

[30] Foreign Application Priority Data

Feb. 5, 1998 [DE] Germany ..... 198 04 523

[51] Int. Cl.[7] ..... B65H 23/18; B65H 18/14

[52] U.S. Cl. ..... 242/413.5; 242/413.6; 242/534; 242/542

[58] Field of Search ..... 242/413.3, 413.5, 242/413.6, 334.6, 542, 534

[56] References Cited

U.S. PATENT DOCUMENTS 2,609,998 9/1952 Sear ..... 242/413.5

5,546,993 8/1996 Summey, III et al. ..... 242/413.5

*Primary Examiner*—John Q. Nguyen

*Attorney, Agent, or Firm*—Friedrich Kueffner

[57] ABSTRACT

A batch winder includes a non-driven compensating roller or dancer roller placed in a loop of a fabric web, wherein the compensating roller is displaceable transversely of its axis of rotation by means of the force of a spring. When the compensating roller is displaced, the compensating roller influences through an initiator an inductive proximity switch which is coupled through an electrical regulating unit to at least one electric motor which drives at least one of the winding rollers which extend parallel to the compensating roller. The compensating roller is integrated so as to be suspended between two swing levers at the end faces of the compensating roller, wherein the swing levers are fixedly attached to a rotary shaft extending parallel to the compensating roller. The rotary shaft is mounted so as to be rotatable in the winder frame by at least one pretensionable torsion spring, wherein the initiator is adjustable by a swing lever relative to the proximity switch and the tension of the fabric web is infinitely variably adjustable by means of a nominal value potentiometer provided for the electronic regulating unit.

5 Claims, 2 Drawing Sheets

BATCH WINDER

BACKGROUND OF THE INVENTION

1. Field of the Invention

The present invention relates to a batch winder including a non-driven compensating roller or dancer roller placed in a loop of a fabric web. The compensating roller is displaceable transversely of its axis of rotation by means of the force of a spring. When the compensating roller is displaced, the compensating roller influences through an initiator an inductive proximity switch which is coupled through an electrical regulating unit to at least one electric motor which drives at least one of the winding rollers which extend parallel to the compensating roller.

2. Description of the Related Art

A batch winder is a winding device following a weaving machine. The batch winder has two winding rollers which are arranged next to each other and parallel to each other, wherein at least one of the winding rollers is driven by an electric motor. For winding a fabric web, a sleeve is placed on each winding roller and the beginning of the fabric web arriving from the weaving machine is attached to the sleeve. The fabric web is wound onto the sleeve by rotating the winding rollers. It is important in this connection that the fabric web is wound with a constant tension because this influences the winding hardness and also the fabric width.

In order to be able to adjust the correct tension of the fabric web, the respective tension is determined by a compensating or dancing roller. The compensating roller is not driven and extends within a loop of the fabric web parallel to and underneath the winding rollers.

In a batch winder which is known in the art, a compensating roller is mounted on a synchronous roller which longitudinally extends through the compensating roller. The synchronous roller supports at the ends thereof gear wheels which roll on racks which, in turn, are attached to the winder frame. As a result, a precise parallel displacement of the compensating roller is ensured. The synchronous roller is supported by means of bearing rollers provided at the ends thereof and by means of travel rails which are also secured to the winder frame. In addition, the ends of the synchronous roller are placed under the influence of tension springs which act in opposite directions and through which a pretensioning of the fabric web can be achieved.

An end of the synchronous roller supports in the area of a side wall of the winder frame an initiator in the form of a rectangular sheet metal plate. This sheet metal plate extends obliquely relative to the horizontal direction, so that an inclined lower surface is provided. Attached underneath this oblique surface to the winder frame is an inductive proximity switch which extends parallel to the sheet metal plate. When the compensating roller is displaced transversely of its axis of rotation, the distance between the initiator and the proximity switch also changes, so that a signal is produced which, through an electronic regulating unit, leads to a change in the rate of rotation of the electric motor and, thus, of the winding speed.

The special support of the compensating roller and the type of transverse displacement of the compensating roller results in a structurally complicated construction. In addition, only a relatively short displacement distance is available for the compensating roller. Also, the batch winder has various wear components in the form of rotating bearings, gear wheels and racks. Furthermore, the known batch winder is sensitive to dirt. Finally, it is necessary to make available springs with different tension capability in order to cover the entire range of tensions of different fabric widths and the necessary tension of the fabric required by properties of the respective fabric.

SUMMARY OF THE INVENTION

Therefore, it is the primary object of the present invention to provide a batch winder of the above-described type which is of simpler construction and which is able to cover over a long displacement distance of the compensating roller a wide range of tension of a fabric web without additional tension elements or tension elements to be added later.

In accordance with the present invention, the compensating roller is integrated so as to be suspended between two swing levers at the end faces of the compensating roller, wherein the swing levers are fixedly attached to a rotary shaft extending parallel to the compensating roller. The rotary shaft is mounted so as to be rotatable in the winder frame by means of at least one pretensionable torsion spring, wherein the initiator is adjustable by means of a swing lever relative to the proximity switch and the tension of the fabric web is infinitely variably adjustable by means of a nominal value potentiometer provided for the electronic regulating unit.

Accordingly, in accordance with the present invention, the compensating roller is integrated so as to be suspended between two swing levers provided at the end faces of the compensating roller. Consequently, the rotary bearings of the compensating roller can be incorporated directly into the compensating roller, and, thus, the rotary bearings can be encapsulated in a manner which is free of dust and not sensitive to dirt. The swing levers preferably constructed of narrow flat irons are positioned at a rotary shaft so as to extend exactly parallel to each other and to project radially from the rotary shaft, so that the parallelism of the compensating roller relative to the winding rollers necessary for a problem-free winding of the fabric web is ensured by the rotary bearing of the rotary shaft. The support of the rotary shaft at the winder frame is effected by means of at least one torsion spring. By selecting the type of torsion spring, the spring force can be determined which must be built up as a counterforce to the tension of the fabric web. Therefore, such a torsion spring permits a large swing angle with an exponential force/distance pattern, so that a wide tension range of the fabric web can be covered. As a result of the capability of the compensating roller of swinging transversely of its axis of rotation, it is no longer necessary to separately deflect the fabric web; this also leads to a simplification of the construction of the batch winder. The pretension of the torsion spring can be changed by a simple relative displacement to the winding roller and/or to the winder frame. The position of the compensating roller at any given time is determined without contact by the adjustment of the initiator connected to a swing lever relative to the proximity switch. The resulting change of the distance leads to a signal which, in turn, leads in the electronic regulating unit to a change of the rate of rotation of the electric motor. The tension of the fabric web is adjusted infinitely variably through the nominal value potentiometer provided for the electronic regulating unit. The nominal value potentiometer may be a rotary potentiometer.

The present invention provides the additional advantage that the special support and swinging capability of the compensating roller means that only horizontal changes of position of the compensating roller are introduced as values into the electronic regulating unit. Vertically directed vibrations and spring actions do not have an effect on the distance to be measured between the initiator and the proximity switch. In addition, an increase of the progressive characteristic occurs.

In accordance with an advantageous further development of the invention, a torsion spring is provided at each end of the rotary shaft.

In accordance with a preferred embodiment, each torsion spring is constructed as a rubber spring which is secured with its elastic casing in the rotary shaft constructed as a pipe and to the inner frame through its rigid central portion. The construction of the rotary shaft in the form of a pipe makes it possible to push a standardized rubber spring from the end faces into the pipe and to anchor the elastic casing in the rotary shaft so that the casing does not rotate relative to the rotary shaft. The central portion of such a rubber spring is usually constructed as a polygonal receiving member of steel. Consequently, it is merely necessary to insert an appropriately constructed polygonal member into the receiving member and to secure it to the winder frame, particularly by means of screws. Moreover, the spring force can be adjusted by varying the length of the rubber springs. The rotary shaft may have a round or polygonal cross-section. The cross-section of the rubber spring is selected accordingly.

In accordance with another feature, the central portion of the torsion spring is adjustable in its relative position to the winder frame. For this purpose, in particular a polygonal member connected to a torsion spring may be welded to a flat iron which protrudes from the polygonal member and can be secured to the winder frame in different angular positions. Consequently, by turning the flat iron, a certain pretension of the torsion springs is adjustable.

In accordance with another feature of the present invention, the initiator is displaceable in the horizontal direction. The initiator composed, for example, of a sheet metal plate, has an inclined surface relative to the horizontal direction, particularly a lower inclined surface. In order to adapt to this inclined surface, the proximity switch is also arranged inclined relative to the horizontal direction. When the compensating roller is swung, this means that the connection of one of the swing levers to the initiator results in a horizontal displacement of the initiator, so that the distance to the inductive proximity switch changes. The electronic signal produced by this change is processed in the electronic regulating unit and is used for providing the electric motor with the desired rate of rotation.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
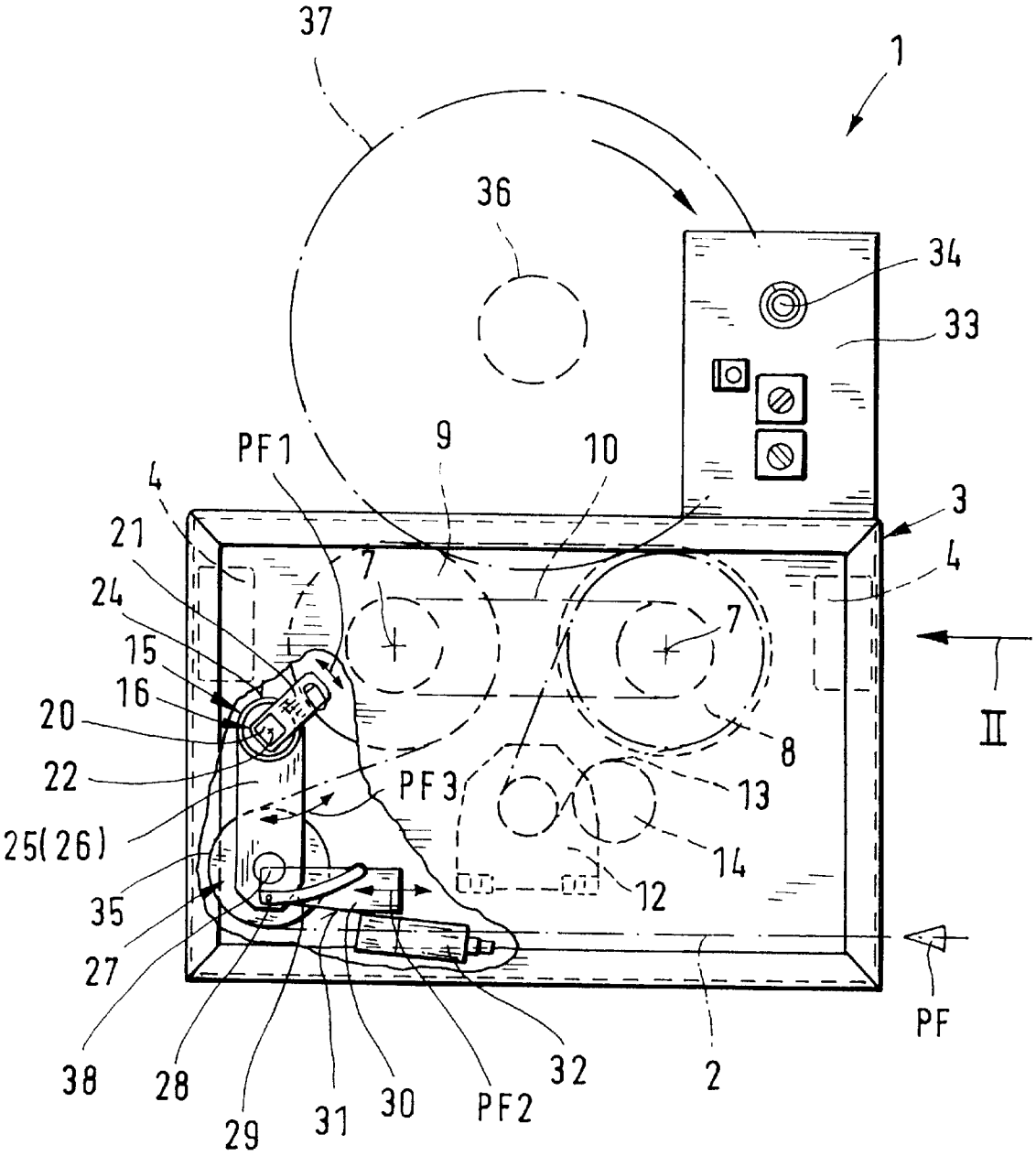
FIG. 1 is a schematic side view of a batch winder according to the present invention.
Figure 2:
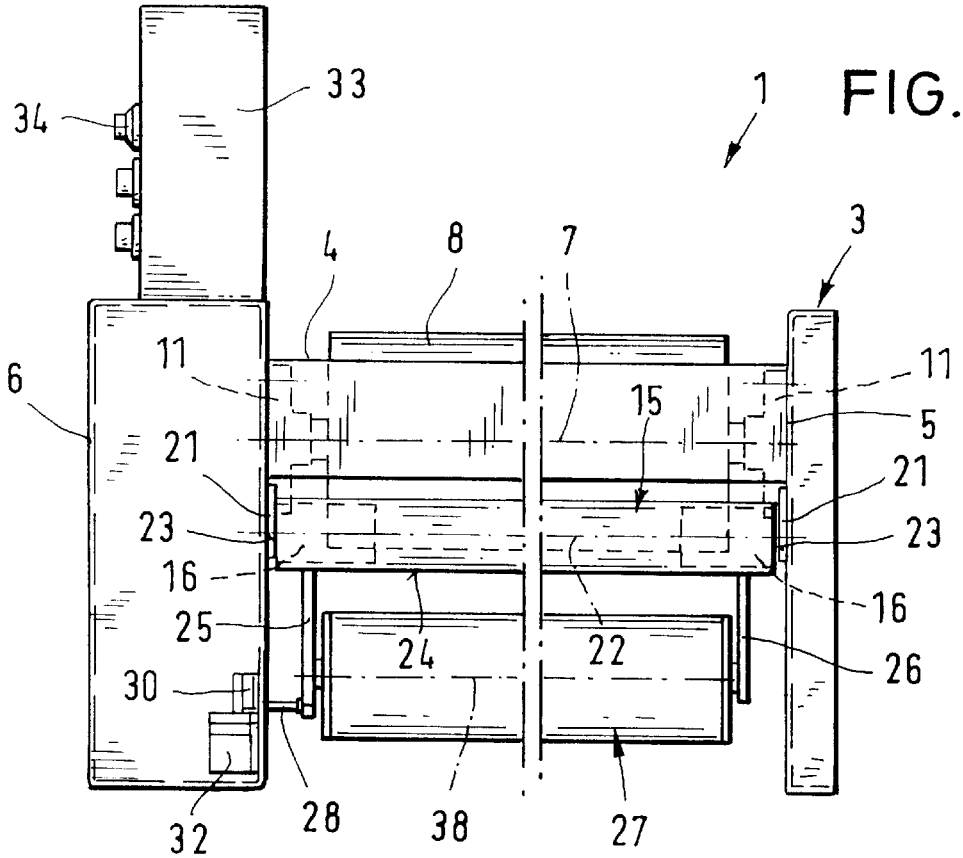
FIG. 2 is an elevational view of the batch winder of FIG. 1 seen in the direction of arrow II of FIG. 1.

FIGS. 1 and 2 of the drawing show a batch winder 1. The batch winder 1 serves to wind a fabric web 2 supplied in the direction of arrow PF from a weaving machine, not shown in detail.

The batch winder 1 has a winder frame 3 with two side walls 5, 6 stiffened by transverse ribs 4. Two winding rollers 8, 9 extend between the two side walls 5, 6. The axes of rotation 7 of the winding rollers 8, 9 extend parallel to each other. The winding rollers 8, 9 are connected to each other through a chain drive 10. The bearings are denoted by reference number 11. The winding roller 8 is driven by an electric motor 12 which is also mounted in the winder frame 3. The drive is effected through a chain drive 13 which is also guided over a tensioning roller 14.

Figure 3:
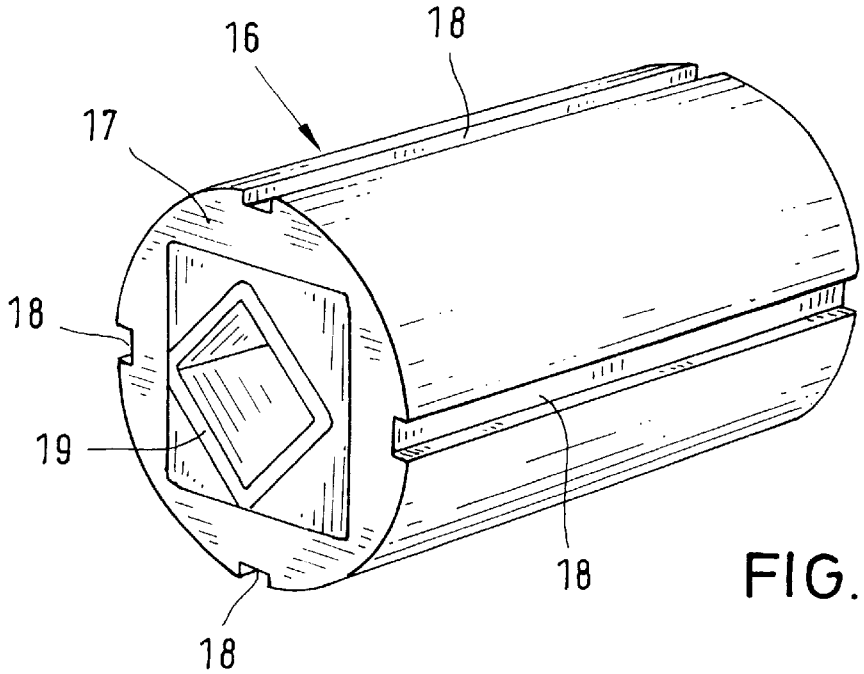
FIG. 3 is a perspective view, on a larger scale, of a torsion spring for the batch winder of FIGS. 1 and 2.

Extending parallel to the winding rollers 8, 9 between the side walls 5, 6 is a tubular rotary shaft 15 having a circular cross-section. Torsion springs 16 in the form of rubber springs and shown in detail in FIG. 3 are inserted into the rotary shaft 15 at the end faces thereof so as to be non-rotatable relative to the rotary shaft 15. In other words, the torsion springs 16 which also have a round cross-section are wedged with their elastic casings 17 and longitudinal grooves 18 in corresponding projections, not shown, in the rotary shaft 15. Steel pipes having a square cross-section extend in longitudinal direction in the torsion springs 16 so as to form central portions 19 of the torsion springs 16. Square rods 20 are inserted without play into these central portions 19 and are screwed to the side walls 5, 6. In addition, each square rod 20 is welded to a radially projecting flat iron 21 which is screwed to the side walls 5, 6 in such a way that a limited adjustment is possible about the axis of rotation 22 of the rotary shaft 15, as indicated by arrow PF1.

Swing levers 25, 26 in the form of flat irons are welded to the outer surface 24 of the rotary shaft 15 in the vicinity of the end faces 23. The swing levers 25, 26 extend downwardly and parallel to each other in the same direction. A compensating roller 27 is integrated in a suspended manner between the swing levers 25, 26. The internal rotary bearings of the compensating roller 27 are not illustrated in detail. The axis of rotation is denoted by reference number 38.

One of the swing levers 25 is provided with a pin-like drive member 28 which protrudes through an oblong hole 29 having an arc-shaped configuration into the box-shaped side wall 6 and is connected within the side wall 6 to an initiator 30 in the form of a sheet metal plate. The initiator 30 is horizontally displaceable in the direction of arrow PF2. The initiator has a lower inclined surface 31 which is inclined relative to the horizontal direction. Extending parallel to this inclined surface 31 in the side wall 6 is an inductive proximity switch 32 which is coupled, in a manner not illustrated, to an electronic regulating unit 33 arranged on the side wall 6. The electronic regulating unit 33 includes a nominal value potentiometer 34 and is coupled to the electric motor 12.

The compensating roller 27 is placed in a loop 35 of the fabric web 2 arriving from the weaving machine. The fabric web 2 is then guided around the winding roller 9 and is wound onto a sleeve 36 until the desired diameter of the winding 37 has been reached.

The tension of the fabric web 2 can be adjusted infinitely variably by the nominal value potentiometer 34 at the electronic regulating unit 33. An exponential force/distance pattern is adjustable by the counterforce for tensioning the fabric web in the form of the torsion springs 16, so that a large tension range of the fabric web 2 is covered. Since the torsion springs 16 can be pretensioned by means of the flat irons 21, a simple adjustment of the pretension is possible. The parallel displacement of the compensating roller 27 relative to the winding rollers 8, 9 is ensured by the tubular rotary shaft 15 in connection with the torsion springs 16. As a result of the inclined surface 31 at the initiator 30, the distance of the inclined surface 31 to the inductive proximity switch 32 can change when the compensating roller 27 is swung in accordance with PF3, so that the resulting electronic signal is processed in the electronic regulating unit 33 and is used for providing the electric motor with the desired rate of rotation.

While specific embodiments of the invention have been shown and described in detail to illustrate the inventive principles, it will be understood that the invention may be embodied otherwise without departing from such principles.

I claim:

1. A batch winder comprising a winder frame and winding rollers mounted in the winder frame, a non-driven compensating roller placed in a loop of a fabric web and extending parallel to the winding rollers, the compensating roller having an axis of rotation and being configured to be displaceable by a spring force transversely of the axis of rotation, an inductive proximity switch for influencing an initiator by a displacement of the compensating roller, an electric motor for driving at least one of the winding rollers, wherein the inductive proximity switch is coupled through an electronic regulating unit to the electric motor, further comprising a rotary shaft rotatably mounted in the winder frame and pretensioned by at least one torsion spring, the rotary shaft extending parallel to the compensating roller, the compensating roller being integrated so as to be suspended between two swing levers located at end faces of the compensating roller and fixedly connected to the rotary shaft, wherein the initiator is configured to be adjustable relative to the proximity switch by one of the swing levers, and wherein the electronic regulating unit comprises a nominal value potentiometer for infinitely variably adjusting a tension of the fabric web, wherein the at least one torsion spring is a rubber spring having an elastic casing, the rotary shaft being a tubular shaft, wherein the elastic casing of the rubber spring is secured in the tubular rotary shaft, and wherein the rubber spring has a rigid central portion secured to the winder frame.

2. The batch winder according to claim 1, wherein the at least one torsion spring comprises a torsion spring each at ends of the rotary shaft.

3. The batch winder according to claim 1, wherein the initiator comprises an oblique surface inclined relative to a horizontal direction, wherein the proximity switch is arranged in an oblique position, and wherein one of the swing levers comprises a drive member for displacing the initiator relative to the proximity switch in the horizontal direction.

4. The batch winder according to claim 1, wherein the central portion of the at least one torsion spring is configured to be adjustable in a relative position to the winder frame.

5. A batch winder comprising a winder frame and winding rollers mounted in the winder frame, a non-driven compensating roller placed in a loop of a fabric web and extending parallel to the winding rollers, the compensating roller having an axis of rotation and being configured to be displaceable by a spring force transversely of the axis of rotation, an inductive proximity switch for influencing an initiator by a displacement of the compensating roller, an electric motor for driving at least one of the winding rollers, wherein the inductive proximity switch is coupled through an electronic regulating unit to the electric motor, further comprising a rotary shaft rotatably mounted in the winder frame and pretensioned by at least one torsion spring, the rotary shaft extending parallel to the compensating roller, the compensating roller being integrated so as to be suspended between two swing levers located at end faces of the compensating roller and fixedly connected to the rotary shaft, wherein the at least one torsion spring is a rubber spring having an elastic casing, the rotary shaft being a tubular shaft, wherein the elastic casing of the rubber spring is fixedly secured in the tubular rotary shaft, wherein the rubber spring has a rigid central portion secured to the winder frame, wherein the rigid central portion is comprised of metal pipes, wherein, for adjusting a pretension of the torsion spring, the central portion of the torsion spring is configured to be adjustable to a limited extent and is securable in a relative position to the winder frame, wherein the initiator is configured to be adjustable relative to the proximity switch by one of the swing levers, and wherein the electronic regulating unit comprises a nominal value potentiometer for infinitely variably adjusting a tension of the fabric web.

* * * * *